United States Patent [19]

Curry et al.

[11] Patent Number: 4,671,015

[45] Date of Patent: Jun. 9, 1987

[54] RAPID DISMOUNT SECURITY DOOR

[76] Inventors: David G. Curry, 1666 S. Extension Rd. #6101, Mesa, Ariz. 85202; John W. Taylor, 1433 Sanzon Dr., Fairborn, Ohio 45324

[21] Appl. No.: 848,510

[22] Filed: Apr. 7, 1986

[51] Int. Cl.[4] ..... E05C 21/02; E05C 9/00; E05D 15/00

[52] U.S. Cl. ..... 49/465; 16/229; 16/262; 49/390; 49/395

[58] Field of Search ..... 49/395, 389, 465, 390, 49/388; 16/229, 262; 109/59 T, 63, 73

[56] References Cited

U.S. PATENT DOCUMENTS

| | | | |
|---|---|---|---|
| 343,794 | 6/1886 | Brown | 49/395 |
| 547,387 | 10/1895 | Taylor | 70/267 |
| 726,577 | 4/1903 | Schiek | 16/229 |
| 2,756,469 | 7/1956 | Cattermole et al. | 49/465 X |
| 3,197,807 | 8/1965 | Persson | 49/390 X |
| 3,261,029 | 7/1966 | Beneke, Jr. | 16/229 X |
| 3,991,595 | 11/1976 | Bahry et al. | 70/120 |
| 4,288,944 | 9/1981 | Donovan | 49/395 |
| 4,307,542 | 12/1981 | Lense | 49/390 X |
| 4,414,777 | 11/1983 | Masacchia | 49/395 X |

*Primary Examiner*—Philip C. Kannan

*Attorney, Agent, or Firm*—Gerald B. Hollins; Donald J. Singer

[57] ABSTRACT

A quickly demountable security-conscious door having a four-pin engagement with the adjacent door frame and having a plurality of rack and pinion mechanisms for movement of the hinge pin and lock bolt members into engagement positions with respective receptacles located in the door frame member. The door includes weather stripping provisions, operating knob rotational limits, and operating shaft spring assistance and uses Teflon ® or other low-friction materials in appropriate frictional engagement positions.

10 Claims, 3 Drawing Figures

RAPID DISMOUNT SECURITY DOOR

RIGHTS OF THE GOVERNMENT

The invention described herein may be manufactured and used by or for the Government of the United States for all governmental purposes without the payment of any royality.

BACKGROUND OF THE INVENTION

This inention relates to the field of security door assemblies of the quickly removable type.

In military and other security conscious uses, there frequently exists a need for an aperture closing door and door frame assembly which enables at least moderate security against both tampering and forceful entry attempts, but which is nevertheless quicky and easily removed from its mountings. Door of this type are frequently employed, for example, at the entrance(s) of conference rooms used for militarily secured briefings and other meetings. The removal of such doors is, however, often desired to allow maximum dimension usage of the door frame aperture or for repair and replacement of the door mechanism or other portions of the door assembly or for temporary conversion of the room to other uses. Many such door arrangements also require consideration of the door operating friction along with the incorporation of sealing arrangements to preclude air leakage through the space surrounding the door body—the space between door body and door frame members. Security considerations in such door assemblies additionally often make the use of vertically-oriented door bolts preferably to the normal horizontally-oriented bolt.

The patent art includes several examples of doors, door lock mechanisms, and door suspension arrangements. This patent art includes the patent of Millard F. Brown, U.S. Pat. No. 0,343,794, which shows the use of rack and pinion mechanisms to extend or retract horizontally disposed bolt locks upon rotation of a single knob located on the door face.

This art also includes the patent of Thomas Talyor, U.S. Pat. No. 547,387, which shows the use of a single knob or shaft to achieve rack and pinion extension of lock bolt members located on all four sides of a rectangular door member.

This art also includes the patent of Abraham Bahry et al, U.S. Pat. No. 3,991,595, which concerns the use of a single key operated pinion to drive a gear that is camwise connected to a plurality of lock bolt members extending to the four sides of the door.

This art also includes the patent of George H. Scheik, U.S. Pat. No. 726,577, which shows use of extendable and retractable lock bolt members operating from a single shaft and arranged as the pivoting pins in a separatable hinge structure.

Another hinge and lock bolt arrangement is shown in the patent of Wilhelm K. Schmidt, U.S. Pat. No. 1,972,575, which concerns a door having linearly movable lock bolt members, one located at each lateral extremity of the door and usable as both the lock bolt member and as a hinge pin member, depending upon the positioning selected for the bolt actuating mechanism. The lock bolts of the Schmidt invention further include a camming arrangement for applying pressure to a resilient sealing member located intermediate the door and door frame members.

Additional objects and features of the invention will be understood from the following description and the accompanying drawings.

These and other objects of the invention are achieved by a bidirectionally pivoting, removable security door apparatus which includes the combination of a door frame member annularly disposed around the internal perimeter of a door closable opening, the frame member defining a rectangular aperture having edges of length L and width W, a rectangular door body member of clearance diminished L and W edge dimensions receivable in predetermined small annular air gap clearance relationship within the frame member aperture, a first hinge pivot assembly received within the door body member adjacent a first L dimensioned edge thereof and including a rack and pinion retractable pivot pin portion extending from within the body member parallel with the L dimensioned edges through a first W dimensioned door edge across one W dimensional leg of the annular air gap into a first W dimensional frame member edge, a first friction limiting bearing member received in the first frame member W dimensioned edge surrounding the first pivot pin portion therein, a second hinge pivot assembly received within the door body member adjacent the first L dimensioned edge thereof, axially aligned with the first hinge pivot assmbly and physically segregated therefrom, also including a rack and pinion retractable pivot pin portion extending from within the body member parallel with the L dimensioned edges through the second W dimensioned door edge across the second W dimensioned leg of the annular air gap into the second W dimensioned frame member edge, a second friction limiting bearing member received in the second frame member W dimensioned edge surrounding the second pivot pin portion therein, a first striker plate member received in the first frame member W dimensioned portion adjacent the second L dimensioned edge thereof and including a first plunger receiving aperture therein, a first rack and pinion actuated bolt assembly having a first elongated plunger bolt member located within the door body member adjacent and parallel of the second L dimensioned edge thereof and extendable from within the body member parallel with the L dimensioned edges through the first W dimensioned leg of the annular air gap into the first W dimensioned frame member edge first striker plate member, a second strike plate member received in the second frame member W dimensioned portion adjacent the second L dimensioned edge thereof and including a second plunger receiving aperture therein, a second rack and pinon actuated bolt assembly having a second elongated plunger bolt member located within the door body member adjacent and parallel of the second L dimensioned edge thereof and extendable from within the body member parallel with the L dimensioned edges through the second W dimensioned leg of the annular air gap into the second W dimensioned frame member edge second striker plate member, resilient urging means connected with the first and second rack and pinion actuated bolt assemblies for urging the plunger members toward a predetermined position thereof, rotational stop means connected with the rack and pinion actuated bolts for terminating the travel limit of the plunger bolt members at predetermined position limits, resilient sealing means attached to the door body member along at least the first L dimensioned edge thereof and extending across the air gap between the door edge and frame edge for sealing the air gap.

DETAILED DESCRIPTION

Figure 1:
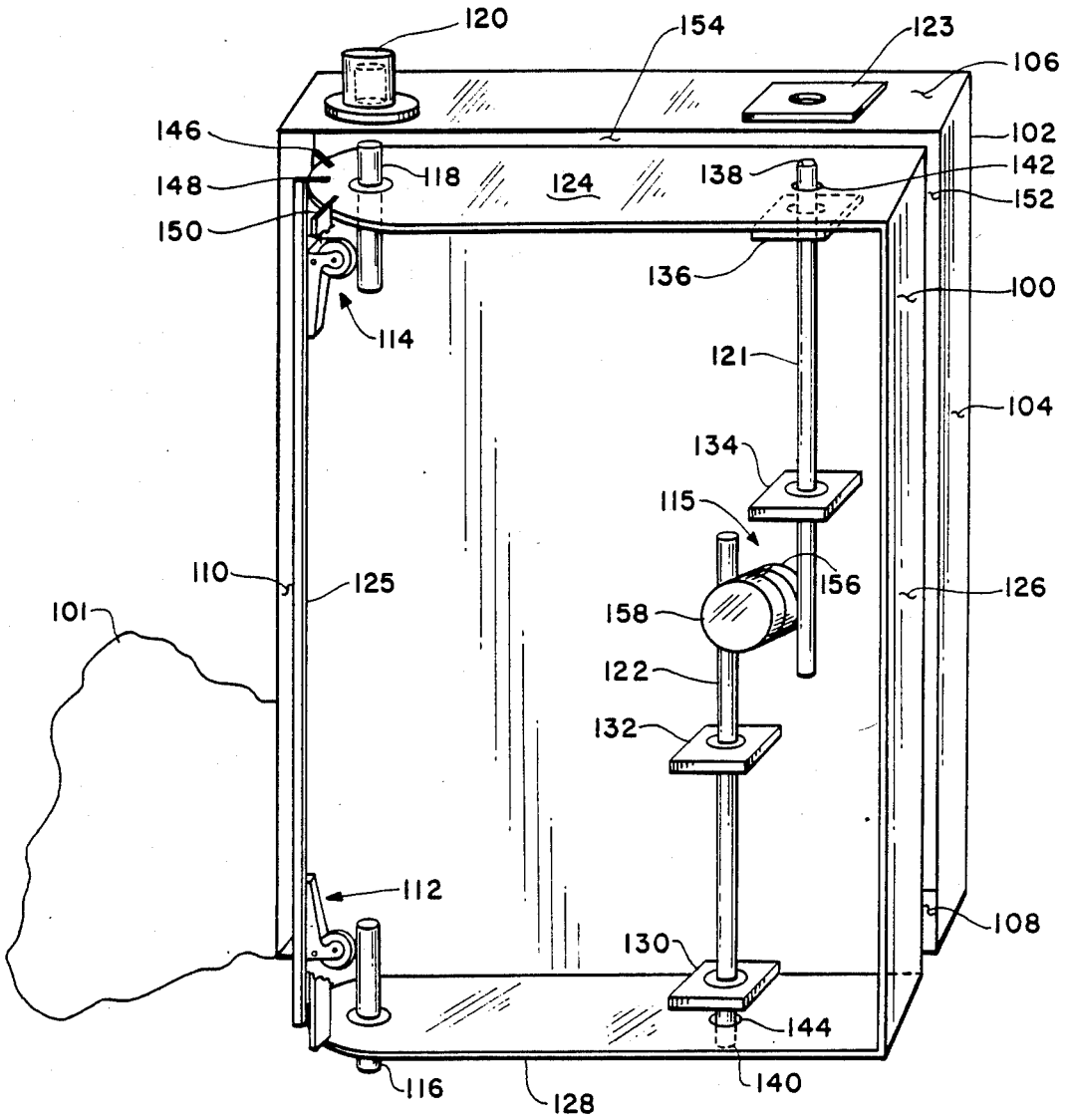
FIG. 1 is a composite view of a door and door frame arrangement made in accordance with the invention.

In FIG. 1 of the drawings there is shown an overall perspective view of a medium security door 100 and an accompanying door frame 102. The frame 102 of the FIG. 1 door is mounted in a closable opening of a planar surface that is shown in represented form at 101. The door 100 includes a top edge portion 124, a vertical edge portion 126 and oppositely disposed edge portions 125 and 128. The frame 102 in FIG. 1 includes a top edge portion 106, a vertical edge portion 104, and oppositely disposed edges 108 and 110, respectively. The frame edge portions 106, 108, 104, and 110 are preferably arranged to have width and length dimensions of W and L, respectively, and the door edges 124, 128, 126, and 125 to have dimensions of W and L which are clearance diminished by a small amount in order to provide operating or movement clearance space for the door, as is indicated at 152 and 154. An annular clearance space therefore surrounds the door 100 and lies intermediate the door 100 and the frame 102.

Received in the interior of the door 100 are a pair of hinge mechanisms 112 and 114, and the locking mechanism 115. The hinge mechanisms cooperate with friction limiting bearing members mounted on the frame 102, one of these friction limiting bearing members is shown at 120 in FIG. 1. The locking mechanism 115 cooperates with a striker plate 123 located in the top edge portion 106 of the frame 102 and with a similar striker plate located in the opposite or lower edge 108 which is not shown in FIG. 1.

Each of the hinge mechanisms 112 and 114 includes a pivot pin member 116 and 118 which crosses the annular air gap or air space intermediate the door and frame members and is received in the friction limiting bearing 120 and the companion lower bearing which is not shown in FIG. 1. The lock mechanism 115 includes a pair of plunger bolt members 121 and 122 which are guided or limited in movement direction by a pair of guide blocks for each plunger bolt member. The blocks 134 and 136 guide the plunger bolt 121 and the blocks 130 and 132 guide the plunger bolt 122. The plunger bolt members include a beveled or double-beveled end surface 138 and 140. The plunger bolts also pass through a pair of apertures 142 and 144 in the top and bottom edges of the door 100 in reaching the striker plate 123 and the similar lower strike plate. The plunger bolts 121 and 122 are actuated by a rotational gear 156 in rack and pinion fashion; the travel limits of the rotational gear 156 are determined by a rotational stop and spring mechanism which is indicated at 158 in FIG. 1.

The FIG. 1 door and frame apparatus also includes a resilient sealing arrangement such as the lengths of weather stripping 146, 148 and 150 which serve to seal the annular space intermediate the door 100 and frame member 102 on at least one of the lengthwise edges 125. Similar sealing arrangements can be employed around other perimeter portions of the door 100 as needed for complete sealing of the annular air gap. The three lengths of weather stripping 146, 148, and 150 are shown to be mounted in a curved edge portion of the door 100. This curved edge enables pivoting of the door around the hinge pins 116 and 118 without corner collision between the door and frame member and with at least one of the weather strip lengths 146, 148 and 150 being thereby always engaged with the frame edge 110.

Figure 2:
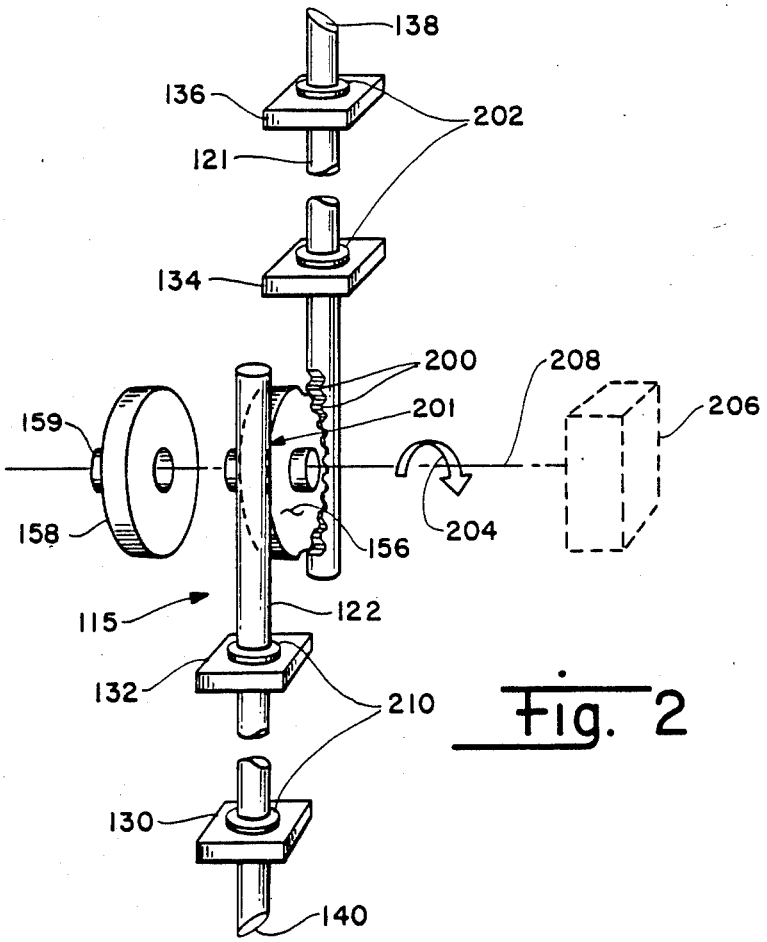
FIG. 2 shows additional details of the locking mechanism for the FIG. 1 door.

FIG. 2 of the drawings is taken from an alternate perspective angle in comparison with FIG. 1 and shows additional details of the locking mechanism 115 of FIG. 1. Repeated portions of the FIG. 1 apparatus appearing in FIG. 2 are given the same numbers as used in the FIG. 1 drawing, while newly appearing details first shown FIG. 2 are given numbers in the 200 series. In FIG. 2 therefore, the plunger bolt 121 is shown to include a series of teeth 200, which engage similar teeth located on the periphery of the rotational gear 156. Another set of teeth is located in the plunger bolt member 122 and these teeth also engage the teeth on the periphery of the rotational gear 156, at the interface indicated at 201 in FIG. 2. Rotational movement of the gear 156 is provided by way of a shaft which is located along the center line 208 and which connects with the knob or handle arrangement shown at 206 in FIG. 2. The extent of rotation of the gear 156 and thus the amount of vertical movement of the plunger bolt members 121 and 122 is determined by a coil spring mechanism which includes a rotational stop arrangement. The coil spring is indicated at 158 in FIGS. 1 and 2 and the rotational stop at 159. The spring portion of this apparatus is used to bias the plunger bolt members 121 and 122 toward one predetermined end, preferably the withdrawn position of the plunger bolt members. Withdrawal rotation of the gear 156 is indicated by the arrow 204 in FIG. 2.

Also visible in FIG. 2 are the friction limiting inserts 202 and 210 which are received in the guide blocks 130, 132, 134 and 136 intermediate the block material and the plunger bolts. These inserts may be in the form of bushings made of such material as a fluorinated hydrocarbon, i.e. Teflon® material made by E. I. duPont de Nemours Co. of Wilmington, Delaware, for example. the inserts 202 and 210 of course, allow easy low friction axial movement of the plunger bolts 121 and 122 upon rotation of the gear 156.

The beveled ends of the plunger bolt members 121 and 122, the ends 138 and 140, are shown more clearly in FIG. 2. These beveled ends of course, cooperate with beveled surfaces located on the striker plate 123 to enable movement of the latch mechanism 115 in response to encountering the door frame member, that is, upon a latch extended door closure event. For a doubly swinging or bidirectionally swinging door, a double-beveled end for the plunger bolt members 121 and 122 may be preferably to the single bevel shown in FIG. 2.

Figure 3:
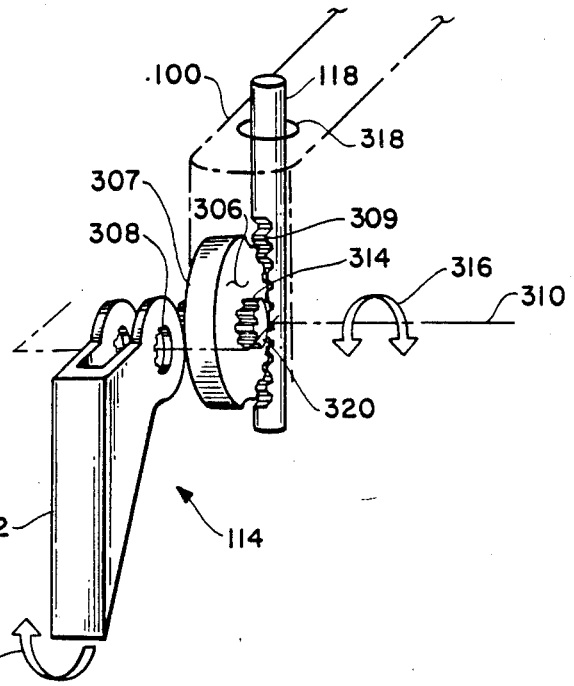
FIG. 3 shows additional details of the hinge mechanism for the FIG. 1 door.

Additional details concerning one of the hinge mechanisms 112 and 114, the upper hinge mechanism 114 are shown in FIG. 3 of the drawings. The hinge mechanism 114 includes the previously identified hinge pin 118 which is received in an axially constrained movement path that is oriented parallel to one of the long edges of the door 100. Axial movement of the hinge pin 118 is provided by rotation of a gear 306 having teeth 307 which engage a mating set of teeth 309 in the hing pin 118. Rotatio of the gear 306 is accomplished by the release lever 302 which is engaged witht he gear 306 by way of a set of splines 308 located in the release lever aperture and a mating set of splines 314 on the gear shaft 320. The gear shaft 320 is, of course, held in vertically and horizontally fixed position with only rotation as a degree of movement freedom in order that rotational movement of the release lever 302 as indicated at 312 will accomplish axial movement of the hinge pin 118.

Preferably, the release lever 302 is mounted in a recessed position at or below the surface of the door 100 on the edge portion thereof. In this position access to the release lever 302 requires that the door be in one of the extreme open positions. The rotation imparted to the splined shaft 320 and the gear 306 by the release lever 302 is indicated by the arrow 316 in FIG. 3. This rotational movement provides axial movement of the hinge pin 118 within the edge opening 318.

The door 100 may be fabricated of metal, wood, combinations of metal and wood or of plastics, or from other fabrication materials as are known in the art. The hinge and lock mechanisms 112, 114, and 115 are of course, preferably made of steel or brass or high-strength materials. The hinge pins 116 and 118 and the plunger bolt members 121 and 122 are preferably fabricated of hardened material such as high-carbon steel, in order to provide resistance against cutting and other abuse. The door frame 102 may be fabricated of metal, wood, or other materials known in the art.

User of the four elongated and preferably hardened members, that is, the hinge pins 116 and 118, and the plunger bolt members 121 and 122 as a four-point engagement between the door 100 and the frame 102 of course, provides a rigid and secure structure which is susceptible to violation only with extreme methods. Use of the four vertical shafts to lock the door 100 in the frame 102 is capable of making the FIG. 1 door highly resistant to forcing by impact or prying. Prying, for example, requires two persons working simultaneously to be accomplished.

The disclosed door apparatus may also be arranged to use solenoid or motor-driven mechanisms to achieve movement of the lock bolts or indeed, even of the hinge pin members. The friction limiting bearings described in the several locations of the invention may be arranged through the use of low-friction materials such as bronze, babbitt, the above-mentioned Teflon® material, or other bearing materials, and may of course, also employ ball or roller bearings, all as are known in the bearing art.

The size of the disclosed door apparatus is, of course, a matter of design choice. Actual embodiments of the invention may depart from the room size door contemplated in the description herein in either the smaller or larger direction and thereby may encompass such diverse door uses as a door for a small portable safe, the door for a small security compartment in a building (e.g., cable vault) and the larger doors for equipment moving operations. Corresponding variations in the size of huge pins, plunger bolts, and other elements of the door structure are, of course, contemplated for these embodiments. The recited door sizes and uses are of course intended to be exemplary rather than limiting in nature.

While the apparatus and method herein described constitute a preferred embodiment of the invention, it is to be understood that the invention is not limited to this precise form of apparatus or method, and that changes may be made therein without departing from the scope of the invention, which is defined in the appended claims.

We claim:

1. Bidirectionally pivoting removable security door apparatus comprising the combination of:

a door frame member annularly disposed around the internal perimeter of a door closable opening, said frame member defining a rectangular aperture having edges of length L and width W;

a rectangular door body member of clearance diminished L and W edge lengths receivable in predetermined small annular air gap clearance relationship within said frame member aperture;

a first hinge pivot assembly received within said door body member adjacent a first L lenth edge thereof and including a rack and pinion retractable pivot pin portion extending from within said body member parallel with said L length edges through a first W dimensional door edge across one W length leg of said annular air gap into a first W length frame member edge;

a first friction limiting bearing member received in said first frame member W length edge surrounding said first pivot pin portion therein;

a second hinge pivot assembly received within said door body member adjacent said first L length edge thereof, axially aligned with said first hinge pivot assmbly and physically segregated therefrom, said assembly including a rack and pinion retractable pivot pin portion extending from within said body member parallel with said L length edges through the second W length door edge across the second W length leg of said annular air gap into the second W length frame member edge;

a second friction limiting bearing member received in said second frame member W length edge surrounding said second pivot pin portion therein;

a first striker plate member received in said first frame member W length portion adjacent the second L length edge thereof and including a first plunger receiving aperture therein;

a first rack and pinion actuated bolt assembly having a first elongated plunger bolt member located within said door body member adjacent and parallel of said second L length edge thereof and extendable from within said body member parallel with said L length edges through said first W length leg of said annular air gap into said first W length frame member edge first striker plate member;

a second striker plate member received in said second frame member w length portion adjacent said second L length edge thereof and including a second plunger receiving aperture therein;

a second rack and pinion actuated bolt assembly having a second elongtaged plunger bolt member located within said door body member adjacent and parallel of said second L length edge thereof and extendable from within said body member parallel with said L length edge through said second W dimensioned leg of said annular air gap into said second W length frame member edge second striker plate member;

resilient urging means connected with said first and second rack and pinion actuated bolt assemblies for urging said plunger members toward a predetermined position thereof;

rotational stop means connected with said rack and pinion actuated bolts for terminating the travel of said plunger bolt members at predetermined position limits;

resilient sealing means attached to said door body member along at least said first L length edge thereof and extending across said air gap between said door edge and frame edge for sealing said air gap.

2. The apparatus of claim 1 wherein said first and second retractable pivot pin portions each include pinion actuating lever members received in said door first L length edge and accessible only when said door is in an open position.

3. The apparatus of claim 2 wherein said first and second elongated plunger bolt members include toothed rack portions actuated by a single common pinion member.

4. The apparatus of claim 3 wherein said first L length edge of said door body member is of rounded cross section.

5. The apparatus of claim 4 further including a plurality of said resilient sealing means located at said rounded cross section edge of said first L length door body

6. The apparatus of claim 5 further including guide block means attached to said door body portion and surrounding said plunger bolt members for limiting movement of said plunger bolt members to axial motion parallel to said L length edges.

7. The apparatus of claim 6 wherein said guide block means includes a pair of axially separated guide blocks received surrounding each said plunger bolt member and each including a friction limiting bearing member located intermediate the guide block and said plunger bolt.

8. The apparatus of claim 7 wherein said frame member friction limiting bearing member and said guide block friction limiting bearing members are each comprised of fluorinated hydrocarbon friction limiting material.

9. Security door apparatus comprising:

a rectangular door body member of L and w vertical and horizontal edge lengths receivable in clearance relationship within a door frame member;

a first hinge pin assembly received within said body member adjacent a first L length vertical edge thereof and including a first toothed rack driven retractable pivot pin portion extending from within said body member in a vertical upward direction parallel with said L length edges, through a first W length door edge, and across a clearange gap into a first frame member portion;

first pinion means including a first toothed pinion member located adjacent said first toothed rack member in toothwise engagement therewith and also including a first lever member received in said first L length door edge and rotationally coupled with said first toothed pinion member for moving said first toothed rack pivot pin portion into and out of said first frame member portion;

a second hinge pin assembly received within said body member adjacent said first L length vertical edge thereof and including a second toothed rack riven retractable pivot pin portion extending from within said body member in a vertical downward direction parallel with said L length edges, through a second W length door edge, and across a clearance gap into a second frame member portion;

second pinion means including a second toothed pinion member located adjacent said second toothed rack member in toothwise engagement therewith and also including a second lever member received in said first L length door edge and rotationally coupled with said second toothed pinion member for moving said second toothed rack pivot pin portion into and out of said second frame member portion;

latch means including a pair of vertically disposed plunger bolt members located adjacent of and parallel with a second L length edge of said door and movable vertically upward and downward into engagement with said first and second frame member portions.

10. The door apparatus of claim 9 wherein said rotational coupling between said toothed pinion members and said lever members includes a splined shaft member.

* * * * *

UNITED STATES PATENT AND TRADEMARK OFFICE

CERTIFICATE OF CORRECTION

PATENT NO. : 4,671,015

DATED : June 9, 1987

INVENTOR(S) : David G. Curry et al

It is certified that error appears in the above-identified patent and that said Letters Patent is hereby corrected as shown below:

Col 1, line 43, "Talyor" should be --Taylor--.

Col 2, line 47, "strike" should be --striker--.

Col 4, line 54, "preferably" should be --preferable--.

Col 4, line 63, "hing" should be --hinge--.

Col 4, line 64, "Rotatio" should be --Rotation--.

Col 4, line 65, "witht" should be --with the--.

Col 5, line 25, "User" should be -- Use --.

Col 6, line 12, Claim 1, "lenth" should be --length--.

Col 6, line 53, Claim 1, "elongtaged" should be --elongated--.

Col 6, line 57, Claim 1, "edge" should be --edges--.

Col 7, line 39, Claim 9, line 2, "w" should be capped.

Col 8, line 19, Claim 9. line 24, "riven" should be --driven--.

Signed and Sealed this

Second Day of February, 1988

*Attest:*

DONALD J. QUIGG

*Attesting Officer*

*Commissioner of Patents and Trademarks*